US006705928B1

(12) United States Patent
Barns

(10) Patent No.: US 6,705,928 B1
(45) Date of Patent: Mar. 16, 2004

(54) THROUGH-PAD SLURRY DELIVERY FOR CHEMICAL-MECHANICAL POLISH

(75) Inventor: Chris E. Barns, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/262,285

(22) Filed: Sep. 30, 2002

(51) Int. Cl.[7] ..... B24B 1/00

(52) U.S. Cl. ..... 451/60; 451/36; 451/41; 451/285; 451/921; 451/526; 51/297

(58) Field of Search ..... 451/41, 60, 36, 451/921, 288–289, 398, 446, 447, 526–530; 51/297, 296

(56) References Cited

U.S. PATENT DOCUMENTS 4,048,763 A * 9/1977 Janssen ..... 451/36
5,554,064 A * 9/1996 Breivogel et al. ..... 451/41
5,658,185 A * 8/1997 Morgan et al. ..... 451/36
5,664,989 A * 9/1997 Nakata et al. ..... 451/41
5,725,420 A * 3/1998 Torii ..... 451/285
5,816,900 A * 10/1998 Nagahara et al. ..... 451/285
5,853,317 A * 12/1998 Yamamoto ..... 451/288
6,095,904 A * 8/2000 Breivogel et al. ..... 451/41
6,530,829 B1 * 3/2003 Kramer ..... 451/527

* cited by examiner

*Primary Examiner*—George Nguyen
(74) *Attorney, Agent, or Firm*—George Chen

(57) ABSTRACT

The present invention describes an apparatus that includes a polish pad, the polish pad including a first through-opening; a vertical distribution layer located below the polish pad, the vertical distribution layer connected to the through-opening; a lateral distribution layer located below the vertical distribution layer, the lateral distribution layer connected to the vertical distribution layer; and a slurry dispense located over a front-side of the polish pad, the slurry dispense to provide a slurry to be transported through the polish pad to the lateral distribution layer.

The present invention further describes a method including dispensing a slurry at a front-side of a polish pad; flowing the slurry to a location below the polish pad; flowing the slurry upwards and outwards, towards edges of the polish pad; and distributing the slurry to an upper surface of the polish pad.

21 Claims, 4 Drawing Sheets

THROUGH-PAD SLURRY DELIVERY FOR CHEMICAL-MECHANICAL POLISH

BACKGROUND OF THE INVENTION

1. Field of the Invention

The present invention relates to the field of semiconductor integrated circuit (IC) manufacturing, and more specifically, to an apparatus for and a method of delivering a slurry through a pad for chemical-mechanical polish (CMP).

2. Discussion of Related Art

A transistor on a chip is usually fabricated from semiconductor material, such as Silicon, and electrically insulating material, such as Silicon Oxide and Silicon Nitride. The transistor is subsequently wired up with electrically conducting material, such as doped polysilicon and metal. The electrically conducting material may be stacked in multiple layers that are separated by electrically insulating material.

In order to improve device density, both the transistor in the front-end of semiconductor processing and the wiring in the back-end of semiconductor processing must be scaled down. The scaling of the transistor and the scaling of the wiring must be carefully balanced in order to prevent degrading performance or reliability.

In 1965, Gordon Moore first observed that the number of transistors per unit area on a chip appeared to double approximately every 18 months. Ever since then, the semiconductor industry has managed to deliver the improvement in device density projected by the so-called Moore's Law.

Maintaining the schedule over the ensuing decades has traditionally required continual enhancements to the processes of photolithography and etch to reduce the critical dimensions (CDs) that can be successfully patterned in the features across the chip. In addition, significant improvements had to be made to the processes of ion implantation, thermal processing, and deposition to produce the desired doping levels and film thicknesses across the chip.

Photolithography was able to keep up with the requisite reductions in CD for each succeeding device generation or technology node. However, improving the resolution for photolithography often required sacrificing the depth of focus (DOF). A shrinking DOF must be counteracted by a reduction in the topography, or surface relief, that inevitably accompanied the processes of etch and deposition. Thus, reduction in topography, or planarization, became necessary for both the front-end and the back-end of semiconductor processing for the most advanced devices.

Chemical-mechanical polish (CMP) is an enabling technology for performing planarization. The process of CMP combines mechanical abrasion and chemical dissolution. Abrasion involves a pad, in conjunction with a slurry of abrasive particles, that flattens and smoothens the relief on a surface. Dissolution involves chemicals in the slurry which react with certain materials at the surface to form soluble byproducts that may be removed.

Successful planarization requires fresh slurry to be properly distributed to, and old slurry to be properly removed from, the interface between an upper surface of the pad and the surface that is being polished. With the transition from 200-millimeter (mm) diameter wafers to 300-mm diameter wafers, the control of polish rate, polish uniformity, and polish selectivity has become ever more dependent on the proper distribution of slurry between the upper surface of the polish pad and the surface that is being polished.

A dual Damascene scheme is often used for CMP of the back-end of semiconductor processing to simultaneously form the trench and the via for each metal level. A thick layer of dielectric material is first formed and patterned. In a via-first implementation, vias are patterned and etched followed by trench patterning and etch. A thin diffusion barrier layer, a thin conductive seedlayer, and a thick metal layer are then deposited sequentially to fill the openings and cover the surrounding dielectric material. A first CMP process may be performed to remove the overburden of the metal over the dielectric material. Another CMP process may subsequently be performed to remove the portions of the barrier layer and the seedlayer outside the openings.

Thus, what is needed is an apparatus for and a method of delivering a slurry through a pad for chemical-mechanical polish.

BRIEF DESCRIPTION OF THE DRAWINGS

FIG. 3 (*b*) is an illustration of an elevation view, at a second angular orientation, of an embodiment of an apparatus for delivering a slurry through a pad for chemical-mechanical polish according to the present invention.

DETAILED DESCRIPTION OF THE PRESENT INVENTION

In the following description, numerous details, such as specific materials, dimensions, and processes, are set forth in order to provide a thorough understanding of the present invention. However, one skilled in the art will realize that the invention may be practiced without these particular details. In other instances, well-known semiconductor equipment and processes have not been described in particular detail so as to avoid obscuring the present invention.

Various embodiments of an apparatus for and a method of delivering a slurry through a pad for a chemical-mechanical polish (CMP) process according to the present invention will be described.

Figure 1:
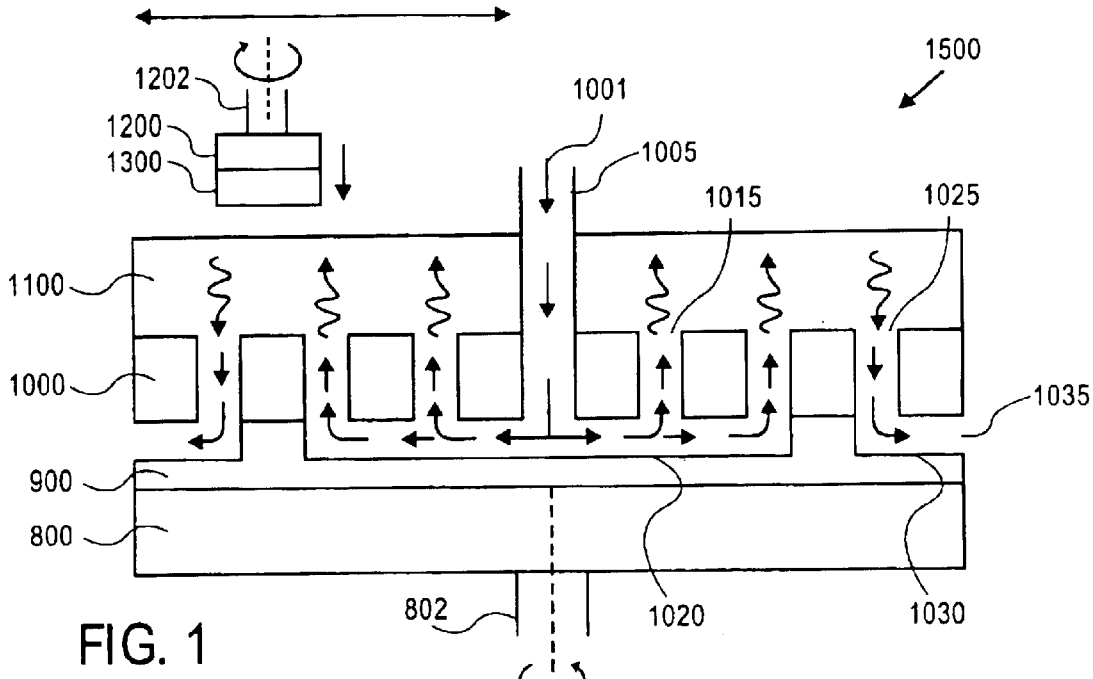
FIG. 1 is an illustration of an elevation view of an embodiment of an apparatus for delivering a slurry through a pad for chemical-mechanical polish according to the present invention.

FIG. 1 is an illustration of an elevation view of an embodiment of an apparatus 1500 for delivering a slurry 1001 through a polish pad 1100 for CMP according to the present invention. A substrate 1300 may be held by a carrier 1200 on a head. The polish pad 1100 may be connected or coupled, through a vertical distribution layer 1000 and a lateral distribution layer 900, to a platen 800. During CMP, the substrate 1300, which may face down, may be in contact with an upper surface of the polish pad 1100, which may face up. A slurry 1001 dispense may be used to provide the slurry 1001 to be transported through the polish pad 1100 to be distributed to an interface between the upper surface of the polish pad 1100 and the substrate 1300.

The slurry 1001 may be dispensed towards the polish pad 1100 side of the platen 800. In one embodiment of the present invention, the slurry 1001 may be dispensed towards the front-side of the polish pad 1100. In one embodiment of the present invention, the slurry 1001 may be dispensed over the front-side of the polish pad 1100 through one or more feed ports.

In one embodiment of the present invention, the slurry 1001 may be dispensed by gravitational force. In another embodiment of the present invention, the slurry 1001 may be dispensed by pressure. In still another embodiment of the present invention, the slurry 1001 may be dispensed by centrifugal pumping.

In an embodiment of the present invention, the slurry 1001 may be dispensed towards the polish pad 1100 at a fixed location. In another embodiment of the present invention, the slurry 1001 may be dispensed towards the polish pad 1100 at a changeable location with an offset from the substrate 1300 or carrier 1200. In still another embodiment of the present invention, the slurry 1001 may be dispensed towards the polish pad 1100 only at a location of the polish pad 1100 that requires more slurry 1001. In yet another embodiment of the present invention, a sliding or spinning coupling, such as a shoe coupling, may be used to dispense slurry at a portion of the front-side of the polish pad 1100.

After dispensing, the slurry 1001 may flow through one or more entry openings in the polish pad 1100. In one embodiment of the present invention, the entry opening may include a recess in the polish pad 1100. In another embodiment of the present invention, the entry opening may include a raised lip or a collar, with or without an underlying recess in the platen 800. The raised lip or collar may increase pressure statically, as a function of its height. In an embodiment of the present invention, the slurry 1001 may flow through a single entry opening at a center of the polish pad 1100.

In an embodiment of the present invention, the slurry 1001 may be dispensed and transported through a vertical inlet pipe 1005 located at the center of the polish pad 1100. After flowing downwards through the vertical inlet pipe 1005 to a location below the polish pad 1100, the slurry 1100 flows through an inlet channel 1020 towards the edges of the polish pad 1100. One or more inlet channels 1020 may be located in the lateral distribution layer 900. In one embodiment of the present invention, the inlet channels 1020 may vary in size, density, and location across the lateral distribution layer 900.

Then, the slurry 1100 flows upwards through an inlet opening 1015. Multiple inlet openings 1015 may be located in the vertical distribution layer 1000. In one embodiment of the present invention, the inlet openings 1015 may vary in size, density, and location across the vertical distribution layer 1000.

The polish pad 1100 may include one or more layers formed from materials, such as urethane and polyester. The stiffness of the polish pad 1100 may be selected to optimize the polish rate, the polish selectivity, the polish uniformity, the extent of erosion, and the extent of dishing.

Next, the slurry 1100 enters into some through-openings at a lower portion of the polish pad 1100. The through-openings are openings which extend through the thickness of the polish pad 1100. The through-openings may include through-pores and through-holes.

In one embodiment of the present invention, the polish pad 1100 may include through-pores that allow the slurry 1001 to flow upwards from the lower portion of the polish pad 1100 towards an upper surface of the polish pad 1100. The slurry 1001 may flow by pressure or centrifugal pumping. In one embodiment of the present invention, the volume fraction of pores, or porosity, may be selected from a range of about 30–80%. The through-pores may be interconnected through the thickness of the polish pad 1100. The great majority of the open and interconnected through-pores should include passages that are large enough to accommodate the particles in the slurry 1001 without clogging. The particles in the slurry 1001 may include a size selected from a range of about 4–2,000 nanometers (nm).

In another embodiment, the polish pad 1100 may include through-holes that allow the slurry 1001 to flow upwards from the lower portion of the polish pad 1100 towards the upper surface of the polish pad 1100. The slurry 1001 may flow by pressure or centrifugal pumping. The through-holes may be approximately columnar, with a cross-section having a diameter selected from a range of about 0.5–4.0 millimeters (mm). The through-holes may be vertical or angled away from the vertical. The spacing of the through-holes across the polish pad 1100 may vary depending on the balance desired between optimal slurry distribution and optimal contact area for CMP.

The upper surface of the polish pad 1100 may have a texture that includes projections and recesses which are derived from the ends of fibers and the ends of voids or grooves. The hardness of the upper surface of the polish pad 1100 may be selected to optimize the polish rate, the polish selectivity, the polish uniformity, the extent of erosion, and the extent of dishing.

The slurry 1001 is then distributed at the interface between the substrate 1300 and the upper surface of the polish pad 1100 for CMP. Some of the slurry 1001 at the upper surface of the polish pad 1100 may flow towards the edges of the polish pad 1100 and some of the slurry 1001 may flow downwards through the through-openings in the polish pad 1100.

The through-openings through the thickness of the polish pad 1100 may include through-pores and through-holes. In one embodiment of the present invention, the polish pad 1100 may include through-pores that allow the slurry 1001 to flow downwards from the upper surface of the polish pad 1100 towards the lower portion of the polish pad 1100. The slurry 1001 may flow by pressure, generated by CMP, or centrifugal pumping. The volume fraction of pores, or porosity, may be selected from a range of about 30–80%. The through-pores may be interconnected through the thickness of the polish pad 1100. The great majority of the open and interconnected through-pores should include passages that are large enough to accommodate the particles in the slurry 1001 without clogging. The particles in the slurry 1001 may include a size selected from a range of about 4–2,000 nm.

In another embodiment, the polish pad 1100 may include through-holes that allow the slurry 1001 to flow downwards from the upper surface of the polish pad 1100 towards the lower portion of the polish pad 1100. The slurry 1001 may flow by pressure, generated by CMP, or centrifugal pumping. The through-holes may be approximately columnar, with a cross-section having a diameter selected from a range of about 0.5–4.0 mm. The through-holes may be vertical or angled away from the vertical. The spacing of the through-holes across the polish pad 1100 may vary depending on the balance desired between optimal slurry distribution and optimal contact area for CMP.

After flowing below the lower portion of the polish pad 1100, the slurry 1001 may flow downwards through an outlet opening 1025. Multiple outlet openings 1025 may be located in the vertical distribution layer 1000. In one embodiment of the present invention, the outlet openings 1025 may vary in size, density, and location across the vertical distribution layer 1000.

Then, the slurry 1001 may flow towards the edges of the polish pad 1100 through an outlet channel 1030. One or more outlet channels 1030 may be located in the lateral distribution layer 900. In one embodiment of the present invention, the outlet channels 1030 may vary in size, density, and location across the lateral distribution layer 900. The slurry 1001 then flows through an exit opening, such as an outlet pipe 1035.

Using discrete components, such as described above, may result in simpler components, lower component cost, simpler maintenance, and greater operational flexibility. However, combining discrete components in various ways to form integrated components (not shown) may result in simpler operation; higher reliability; greater mechanical rigidity; prevention of misalignment of the vertical inlet pipe 1005, the inlet channel 1020, the inlet opening 1015, the outlet opening 1025, and the outlet channel 1030; and prevention of separation of the platen 800, the lateral distribution layer 900, the vertical distribution layer 1000, and the polish pad 1100.

Some embodiments of the integrated components will be described next. In a first embodiment (not shown), the lateral distribution layer 900 may be integrated with the platen 800. In a second embodiment (not shown), both the lateral distribution layer 900 and the vertical distribution layer 1000 may be integrated with the platen 800.

In a third embodiment (not shown), the vertical distribution layer 1000 may be integrated with the polish pad 1100. In a fourth embodiment (not shown), both the vertical distribution layer 1000 and the lateral distribution layer 900 may be integrated with the polish pad 1100.

In a fifth embodiment (not shown), the lateral distribution layer 900 and the vertical distribution layer 1000 may be integrated together.

Figure 2:
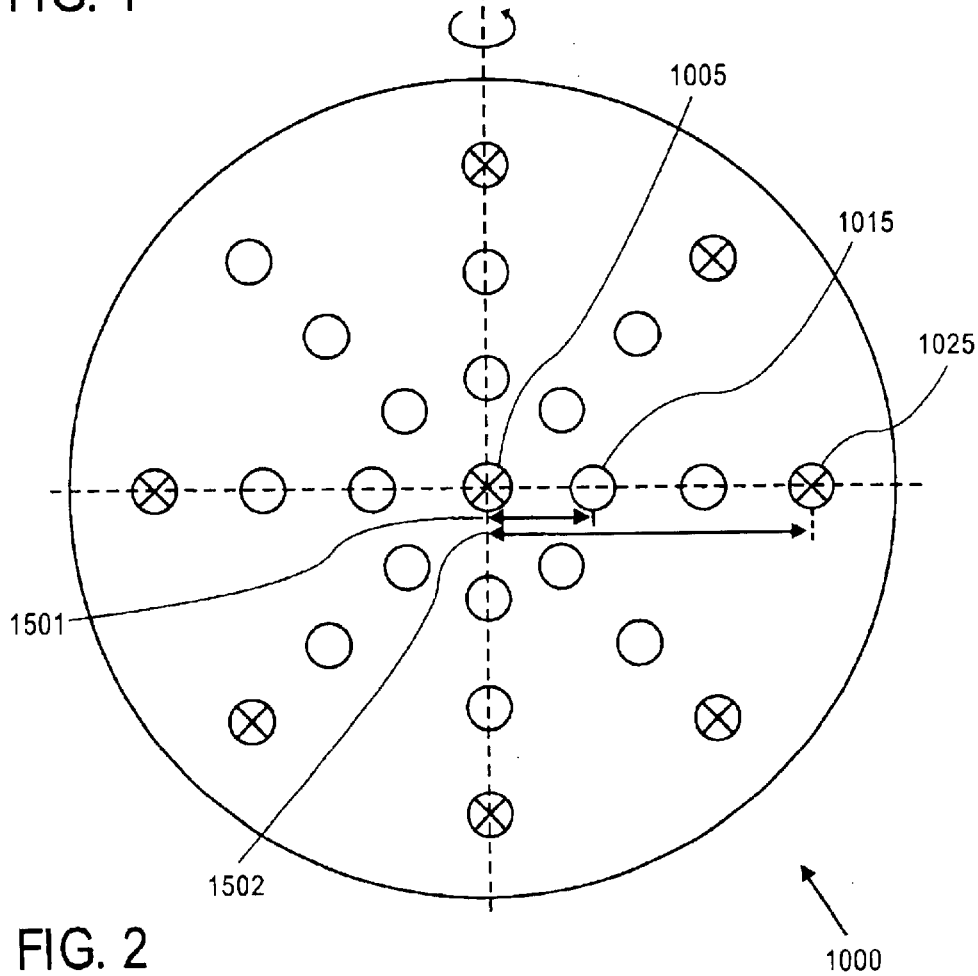
FIG. 2 is an illustration of a plane view of an embodiment of a vertical distribution layer, having an inlet opening and an outlet opening with different radii, in an apparatus for delivering a slurry through a pad for chemical-mechanical polish according to the present invention.

FIG. 2 is an illustration of a plane view of an embodiment of the vertical distribution layer 1000 for delivering the slurry 1001 through the polish pad 1100 for CMP according to the present invention. The vertical distribution layer 1000 has the inlet pipe 1005 that may be located at the center, the inlet opening 1015 located at a first radius 1501, and the outlet opening 1025 located at a second radius 1502. The second radius 1502 may be larger than the first radius 1501.

Various layouts of inlet opening 1015 and outlet opening 1025 may be implemented across the vertical distribution layer 1000. In one embodiment, the inlet openings 1015 may vary in size, density, and location across the vertical distribution layer 1000. In another embodiment, the outlet openings 1025 may vary in size, density, and location across the vertical distribution layer 1000.

Figure 3A:
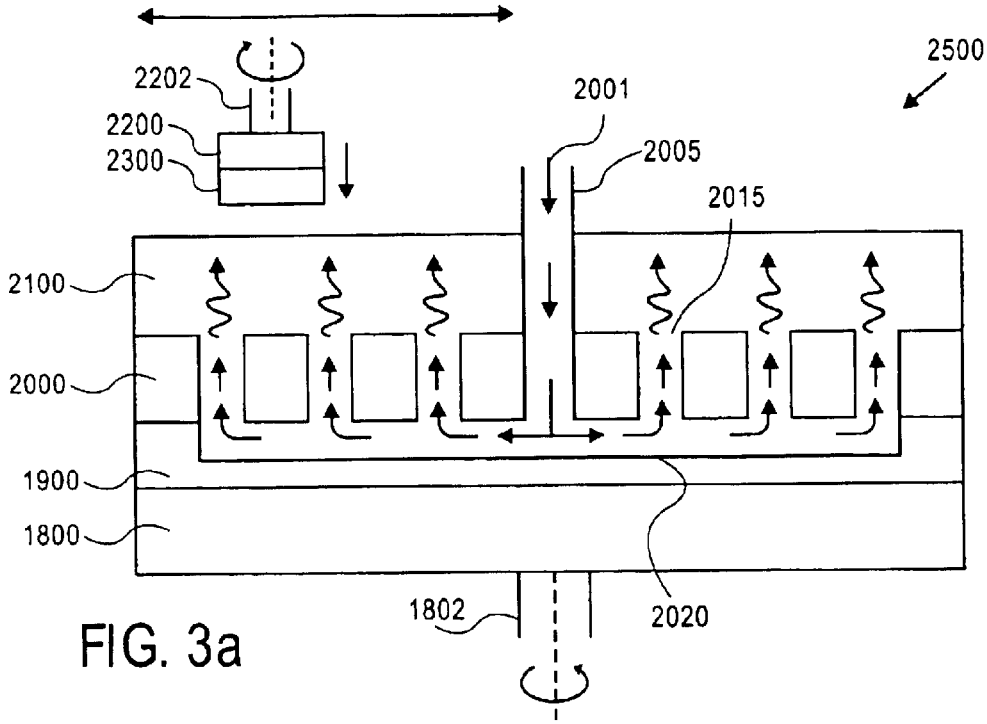
FIG. 3 (*a*) is an illustration of an elevation view, at a first angular orientation, of an embodiment of an apparatus for delivering a slurry through a pad for chemical-mechanical polish according to the present invention.
Figure 3B:
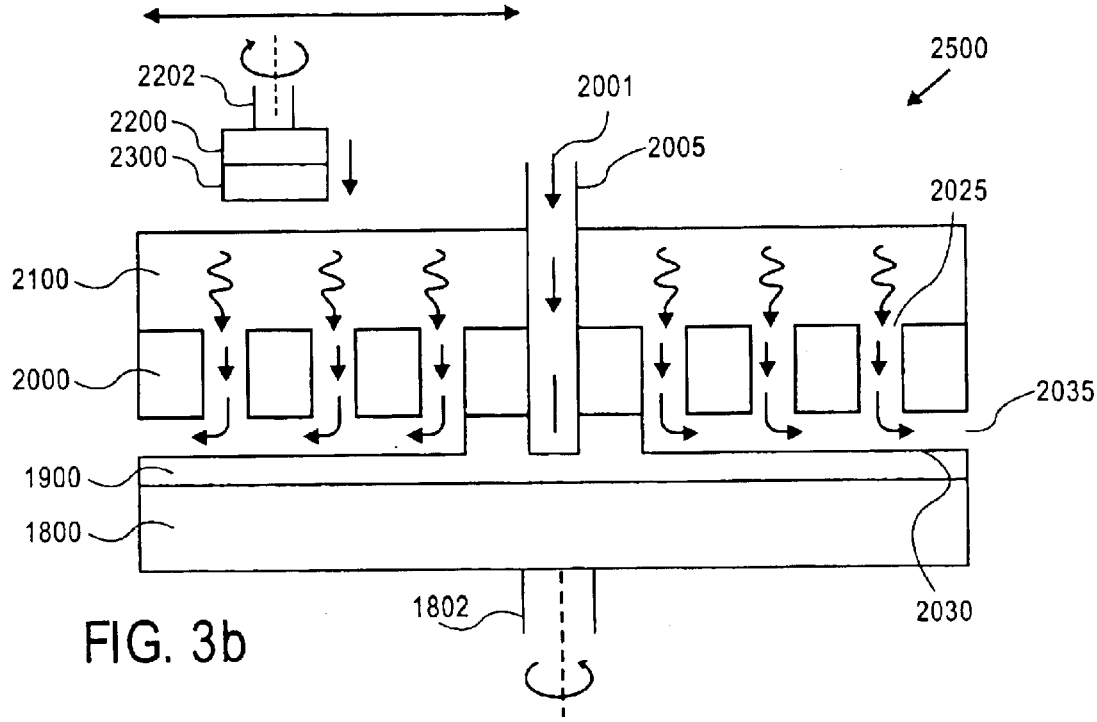

FIGS. 3 (*a*)–(*b*) are illustrations of elevation views of two different angular orientations of an embodiment of an apparatus 2500 for delivering a slurry 2001 through a polish pad 2100 for CMP according to the present invention. Each angular orientation around the circumference of the polish pad 2100 corresponds to a different diameter through the center of the polish pad 2100.

Figure 4:
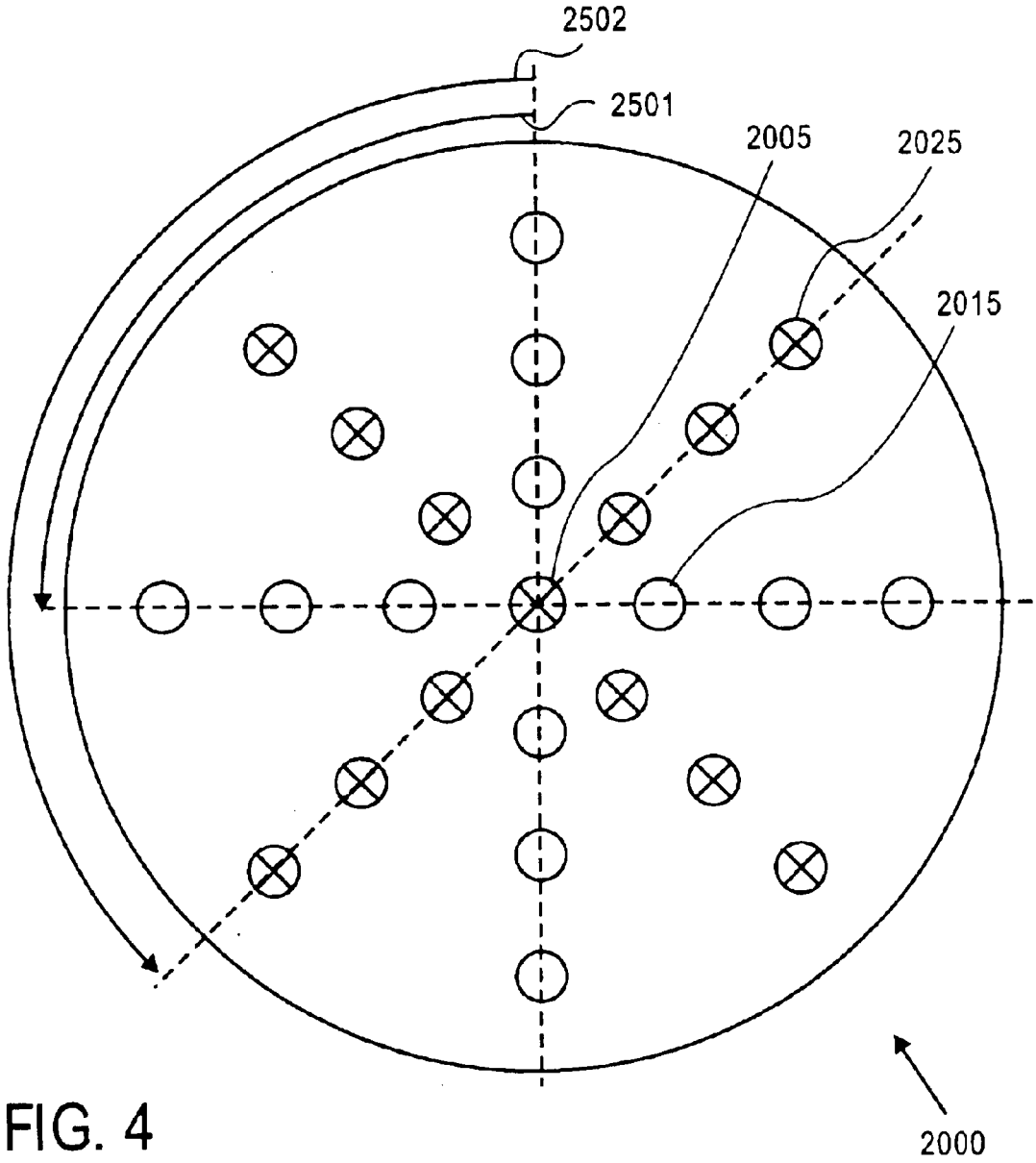
FIG. 4 is an illustration of a plane view of an embodiment of a vertical distribution layer, having an inlet opening and an outlet opening with different angular orientations, in an apparatus for delivering a slurry through a pad for chemical-mechanical polish according to the present invention.

FIG. 3 (*a*) is an illustration of an elevation view, at a first angular orientation 2501, as shown in FIG. 4, of an embodiment of an apparatus 2500 for delivering a slurry 2001 through a polish pad 2100 for CMP according to the present invention. The slurry 2001 is dispensed downwards, such as through a vertical inlet pipe 2005 at a center of the polish pad 2100, flows to a location below the polish pad 2100, flows outwards, towards the edges of the polish pad 2100, through an inlet channel 2020 in a lateral distribution layer 1900, flows upwards through an inlet opening 2015 in a vertical distribution layer 2000, and enters at a lower portion of the polish pad 2100. In one embodiment, the inlet channels 2020 may vary in size, density, and location across the lateral distribution layer 1900. In another embodiment, the inlet openings 2015 may vary in size, density, and location across the vertical distribution layer 2000.

FIG. 3 (*b*) is an illustration of an elevation view, at a second angular orientation 2502, of an embodiment of an apparatus 2500 for delivering a slurry 2001 through a polish pad 2100 for CMP according to the present invention. Slurry 2001 that is squeezed by the CMP pressure exerted between the substrate 2300 and the polish pad 2100, flows downwards through an outlet opening 2025 in the vertical distribution layer 2000, flows towards the edges of the polish pad 2100 through an outlet channel 2030 in a lateral distribution layer 1900, and exits through an outlet pipe 2035. In one embodiment, the outlet channels 2030 may vary in size, density, and location across the lateral distribution layer 1900. In another embodiment, the outlet openings 2025 may vary in size, density, and location across the vertical distribution layer 2000.

The slurry 2001 being squeezed by the CMP pressure out through the outlet opeing 2025 in FIG. 3 (*b*) may not enter the inlet opening 2015 in FIG. 3 (*a*) due to back-pressure from dispensing the slurry 2001. In one embodiment, the upper portion of the outlet opening 2025 may be further from the edges of the polish pad 1100 and the lower portion of the outlet opening 2035 may be nearer the edges of the polish pad 1100 to allow centrifugal pumping to help expel the slurry 2001 through the outlet pipe 2035.

Using discrete components, as described above, may result in simpler components, lower component cost, simpler maintenance, and greater operational flexibility. However, combining discrete components in various ways to form integrated components (not shown) may result in simpler operation; higher reliability; greater mechanical rigidity; prevention of misalignment of the vertical inlet pipe 2005, the inlet channel 2020, the inlet opening 2015, the outlet opening 2025, and the outlet channel 2030; and prevention of separation of the platen 1800, the lateral distribution layer 1900, the vertical distribution layer 2000, and the polish pad 2100.

Some embodiments of integrated components will be described next. In a first embodiment (not shown), the lateral distribution layer 1900 may be integrated with the platen 1800. In a second embodiment (not shown), both the lateral distribution layer 1900 and the vertical distribution layer 2000 may be integrated with the platen 1800.

In a third embodiment (not shown), the vertical distribution layer 2000 may be integrated with the polish pad 2100. In a fourth embodiment (not shown), both the vertical distribution layer 2000 and the lateral distribution layer 1900 may be integrated with the polish pad 2100.

In a fifth embodiment (not shown), the lateral distribution layer 1900 and the vertical distribution layer 2000 may be integrated together.

FIG. 4 is an illustration of a plane view of an embodiment of the vertical distribution layer 2000 for delivering the slurry 2001 through the polish pad 2100 for CMP according to the present invention. The vertical inlet pipe 2005 may be located at the center of the vertical distribution layer 2000. The inlet opening 2015 is located at a first angular orientation 2501 around a circumference of the vertical distribution layer 2000 while the outlet pore 2025 is located at a second angular orientation 2502 around the circumference of the vertical distribution layer 2000.

Many other layouts of inlet openings 2015 and outlet openings 2025 may be implemented across the vertical distribution layer 2000. In one embodiment, the inlet openings 2015 may vary in size, density, and locations across the vertical distribution layer 2000. In another embodiment, the outlet openings 2025 may vary in size, density, and location across the vertical distribution layer 2000.

Figure 5:
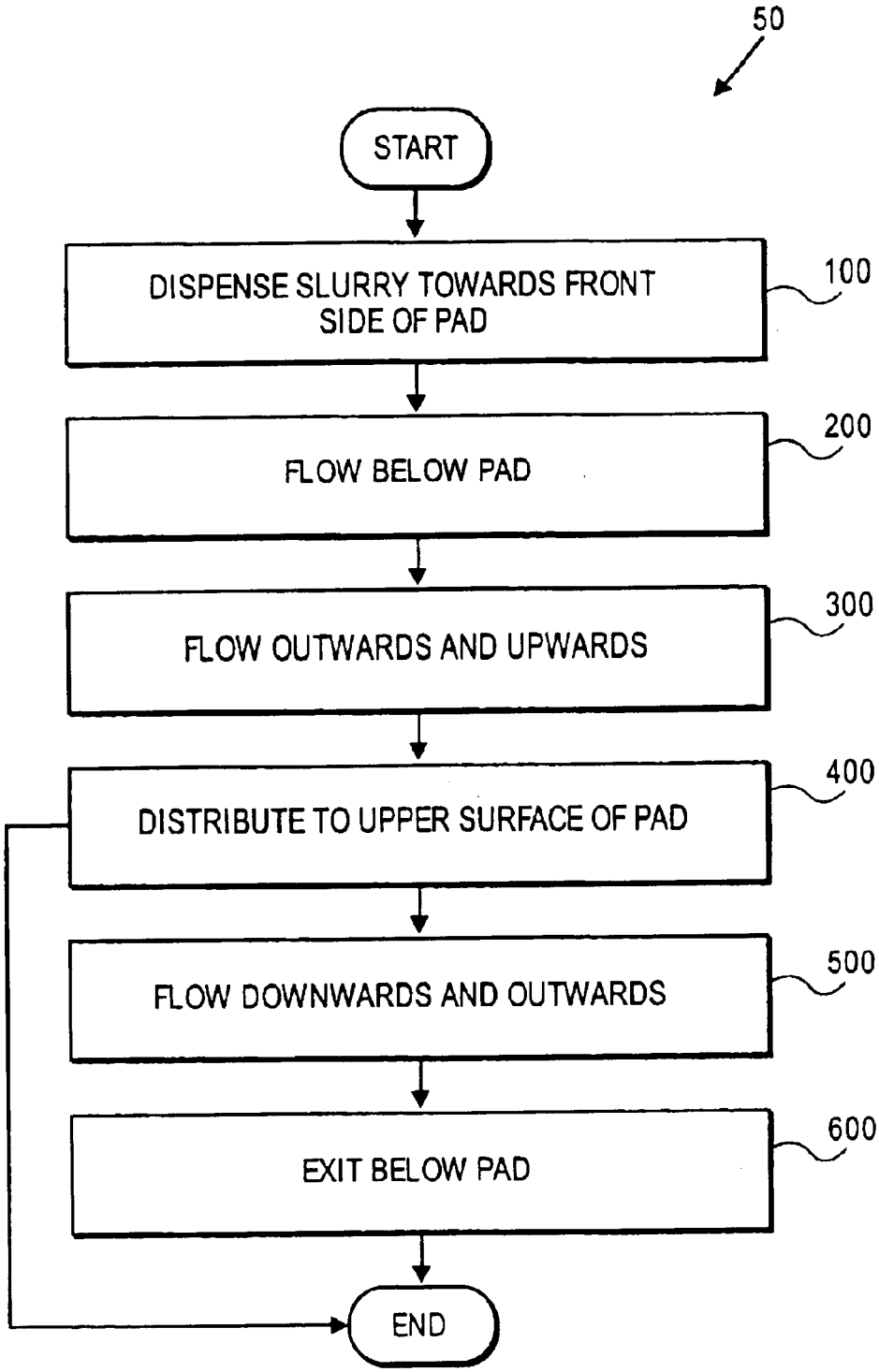
FIG. 5 is an illustration of an embodiment of a method of delivering a slurry through a pad for chemical-mechanical polish according to the present invention.

FIG. 5 is an illustration of an embodiment of a method 50 of delivering a slurry through a polish pad for a chemical-mechanical polish according to the present invention. First, the slurry may be dispensed towards a front-side of a polish pad at 100, by pressure or centrifugal pumping, and flows to a location below the polish pad at 200. The slurry continues to flow outwards, towards the edges of the polish pad at 300, and upwards. Then, the slurry is distributed at 400 through some through-openings in the polish pad to an upper surface of the polish pad for chemical-mechanical polish of a substrate. The through-openings may be through-pores in one embodiment of the present invention. The through-openings may be through-holes in another embodiment of the present invention.

During the process of performing CMP, the substrate and the upper surface of the polish pad may be in contact. Relative motion between the substrate and the polish pad may be provided by rotational, orbital, linear, or some more complex movement of the head and the platen. In one embodiment, a carrier may be connected to a head shaft that may be rotated. A platen may also be connected to a platen shaft that may be rotated. Typical rotational speeds for the carrier and the platen may be selected from a range of about 5–180 revolutions per minute (rpm).

In addition to the relative motion between the substrate and the polish pad, pressure may be exerted to increase the force of contact between the substrate and the upper surface of the polish pad. Pressure may be applied mechanically, hydraulically, or pneumatically to the back of the substrate. Typical pressures may be selected from a range of about 1–10 pounds per square inch (psi).

During the process of performing CMP, slurry may be dispensed, transported, and distributed to an interface where contact is made between the substrate and the upper surface of the polish pad. Typical flowrates for the slurry may be selected from a range of about 50–600 milliliters per minute (ml/min). The slurry may include a suspension of abrasive particles in chemicals. The chemicals in the slurry may react with certain materials at a surface of the substrate to form soluble byproducts that may be removed. The abrasive particles in the slurry may flatten and smoothen the surface of the substrate as a result of the relative motion and pressure between the substrate and the upper surface the polish pad. Planarization of the surface of the substrate involves reduction of the height of the higher portions of the surface down towards the height of the lower portions of the surface.

In one embodiment of the present invention, essentially all of the slurry flows off the upper surface of the pad after CMP. In another embodiment, CMP pressure due to contact of the substrate with the upper surface of the polish pad may cause some of the slurry to flow downwards and outwards, towards the edges of the polish pad at 500 through some through-openings. The through-openings may be through-pores in one embodiment of the present invention. The through-openings may be through-holes in another embodiment of the present invention. Finally, the slurry may exit at 600. In one embodiment, the slurry may be expelled out below the polish pad with centrifugal force.

Many embodiments and numerous details have been set forth above in order to provide a thorough understanding of the present invention. One skilled in the art will appreciate that many of the features in one embodiment are equally applicable to other embodiments. One skilled in the art will also appreciate the ability to make various equivalent substitutions for those specific materials, processes, dimensions, concentrations, etc. described herein. It is to be understood that the detailed description of the present invention should be taken as illustrative and not limiting, wherein the scope of the present invention should be determined by the claims that follow.

Thus, we have described an apparatus for and a method delivering a slurry through a pad for chemical-mechanical polish.

I claim:

1. An apparatus comprising:

a polish pad, said polish pad comprising a first through-opening;

a vertical distribution layer disposed below said polish pad, said vertical distribution layer connected to said through-opening;

a lateral distribution layer disposed below said vertical distribution layer, said lateral distribution layer connected to said vertical distribution layer; and a slurry dispense disposed over a front-side of said polish pad, said slurry dispense to provide a slurry to be transported through said polish pad to said lateral distribution layer.

2. The apparatus of claim 1 wherein said first through-opening distributes slurry to an upper surface of said polish pad.

3. The apparatus of claim 1 wherein said polish pad further comprises a second through-opening wherein said second through-opening removes slurry from an upper surface of said polish pad.

4. The apparatus of claim 1 wherein said vertical distribution layer comprises an inlet opening and an outlet opening.

5. The apparatus of claim 1 wherein said lateral distribution layer comprises an inlet channel and an outlet channel.

6. The apparatus of claim 1 wherein said first through-opening comprises a through-pore.

7. The apparatus of claim 1 wherein said first through-opening comprises a through-hole.

8. The apparatus of claim 3 wherein said second through-opening comprises a through-pore.

9. The apparatus of claim 3 wherein said second through-opening comprises a through-hole.

10. An apparatus comprising:

a first through-opening in a polish pad;

an inlet opening connected to said first through-opening, said inlet opening disposed below said polish pad;

an inlet channel connected to said inlet opening, said inlet channel disposed below said polish pad; and a slurry dispense connected to said inlet channel, said slurry dispense disposed above said polish pad.

11. The apparatus of claim 10 further comprising:

a second through-opening in said polish pad;

an outlet opening connected to said second through-opening, said outlet opening disposed below said polish pad; and an outlet channel connected to said outlet opening, said outlet channel disposed below said polish pad.

12. The apparatus of claim 10 wherein said first through-opening distributes slurry to a surface of said polish pad.

13. The apparatus of claim 11 wherein said second through-opening removes slurry from a surface of said polish pad.

14. The apparatus of claim 10 wherein said first through-opening comprises a through-pore.

15. The apparatus of claim 10 wherein said first through-opening comprises a through-hole.

16. The apparatus of claim 11 wherein said second through-opening comprises a through-pore.

17. The apparatus of claim 11 wherein said second through-opening comprises a through-hole.

18. A method comprising:

dispensing a slurry at a front-side of a polish pad;

flowing said slurry to a location below said polish pad;

flowing said slurry upwards and outwards, towards edges of said polish pad; and distributing said slurry to an upper surface of said polish pad.

19. The method of method 18 further comprising;

flowing said slurry downwards and outwards, toward said edges of said polish pad.

20. The method of claim 18 wherein centrifugal force results in flowing of said slurry.

21. The method of claim 19 wherein centrifugal force results in flowing of said slurry.

* * * * *